US007986316B2

(12) United States Patent
Correa et al.

(10) Patent No.: US 7,986,316 B2
(45) Date of Patent: Jul. 26, 2011

(54) METHOD AND APPARATUS FOR POWER LEVEL CONTROL IN A DISPLAY DEVICE

(75) Inventors: Carlos Correa, Villingen-Schwenningen (DE); Cédric Thebault, Villingen-Schwenningen (DE); Rainer Zwing, Villingen (DE)

(73) Assignee: Thomson Licensing, Boulogne-Billancourt (FR)

( * ) Notice: Subject to any disclaimer, the term of this patent is extended or adjusted under 35 U.S.C. 154(b) by 1295 days.

(21) Appl. No.: 11/594,290

(22) Filed: Nov. 8, 2006

(65) Prior Publication Data

US 2007/0103398 A1 May 10, 2007

(30) Foreign Application Priority Data

Nov. 10, 2005 (EP) ..... 05292385

(51) Int. Cl.
*G09G 5/00* (2006.01)

(52) U.S. Cl. ..... 345/212; 345/60; 345/61; 345/62; 345/63

(58) Field of Classification Search ..... 345/212, 345/60–63
See application file for complete search history.

(56) References Cited

U.S. PATENT DOCUMENTS

2002/0003522 A1* 1/2002 Baba et al. ..... 345/89

FOREIGN PATENT DOCUMENTS

| | | | |
|---|---|---|---|
| EP | 0 852 400 | A1 * | 1/1998 |
| EP | 0 851 400 | A | 7/1998 |
| EP | 1 437 706 | A | 7/2004 |
| WO | WO 00/46782 | A | 8/2000 |

OTHER PUBLICATIONS

Search Report Dated May 30, 2006.

* cited by examiner

*Primary Examiner* — Richard Hjerpe
*Assistant Examiner* — Leonid Shapiro
(74) *Attorney, Agent, or Firm* — Robert D. Shedd; Jeffrey M. Navon

(57) ABSTRACT

The invention relates to a method for power level control of a display device and an apparatus for carrying out the method. Classically, a power level mode defining a subfield organization to be used for subfield coding is selected as a function of the average power level of the picture to be displayed for keeping constant the power consumption of the display device. According to the invention, it is proposed to select the power level mode as a function of the input frame frequency in such a way as to have as little as possible deviations from nominal peak white and full white values at the same time that an overloading of the panel power supply is prevented. More particularly, the number of sustain pulses within the video frame and selected by the power level mode is modified as a function of the input frame frequency.

5 Claims, 3 Drawing Sheets

METHOD AND APPARATUS FOR POWER LEVEL CONTROL IN A DISPLAY DEVICE

This application claims the benefit, under 35 U.S.C. 119, of EPpatent application no. 05292385.1 filed 10 Nov. 2005.

FIELD OF THE INVENTION

The invention relates to a method for power level control of a display device and an apparatus for carrying out the method.

More specifically the invention improves the input frame frequency operating range of display devices based on the principle of duty cycle modulation (pulse width modulation) of light emission, like plasma display panels (PDP), at the same time that picture brightness and quality are kept approximately identical to the nominal input frame frequency values.

BACKGROUND OF THE INVENTION

Today, the Plasma technology makes possible to achieve flat colour panel of large size (out of the CRT limitations) and with very limited depth without any viewing angle constraints. Like CRT (Cathode Ray Tube) technology, PDP is a technology that generates its own light. In the same way, both technologies use a power management (or brightness regulation) circuit which allows a higher peak white brightness value than a full white value.

The CRT screens use a so called ABL (for Average Beam-current Limiter) circuit, which is implemented by analog means usually in the video controller, and which decreases video gain as a function of average luminance usually measured over an RC stage.

The plasma display panels use a so called APL (for Average Power Level) control circuit that generates less or more sustain pulses as a function of the average power level of the displayed picture. The APL control starts from the reflection that for larger peak white luminance values in plasma displays more sustain pulses are necessarily required. On the other hand, more sustain pulses correspond also to a higher power consumption of the PDP. Thus the solution is a control method which generates more or less sustain pulses as a function of the average picture power, i.e. it switches between different modes with different power levels. Such an APL control circuit is described in the international patent application WO 00/46782. For pictures having relatively low picture power, i.e. a lot of pixels with relatively low luminance value, a mode will be selected which uses a high number of sustain pulses to create the different video levels because the overall power consumption will be limited due to a great amount of pixels with low luminance value. For pictures having relatively high picture power, i. e. a lot of pixels with relatively high luminance value, a mode will be selected which uses a low number of sustain pulses to create the different video levels because the overall power consumption will be high due to a great amount of pixels with high luminance value. Thus, a plurality of power level modes can be defined for a good management of the power consumption.

The APL control is implemented as follows: first the average video level of the input signal after de-gamma is computed. This value is a good estimation of the total luminance power required for reproducing the input picture. Secondly, by means of a look-up table, the total number of sustain pulses that can be generated for the input picture to keep the power consumption in an authorized range is determined and a corresponding subfield organization is simultaneously selected. As described in the international patent application WO 00/46782, the sub-field organizations can vary in respect to one or more of the following characteristics:

the number of sustain pulses;

the number of sub-fields;

the sub-field positioning.

This solution is optimized for a given frame frequency. Indeed, the input frame frequency is usually constant but it can change if the panel is connected to a non-standard video source, for instance a video cassette recorder in trick mode. It is the same when the panel is connected to a computer. For some graphic cards, the frequency can deviate considerably from the nominal frequency. So it makes difficult to track a range of frame frequencies, without undesired effects like overloading the power supply, or reducing the panel peak white and full white values.

SUMMARY OF THE INVENTION

It is an object of the present invention to disclose a new method and apparatus for power level control taking into consideration the frame frequency of the picture to be displayed.

According to the invention, the subfield organization is selected as a function of the average power level and the frame frequency of the picture to be displayed.

According to the invention, this objective is solved by a method for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame. It comprises a step for determining a power value which is characteristic for the power level of the picture to be displayed, and a step for measuring the frame frequency of the input picture, and a step for selecting a power level mode based on said power value and said frame frequency.

In practice, the number of sustain pulses of the power level mode which would selected only as a function of the power value is decreased if the input frequency is higher than a nominal frequency and increased if the input frequency is lower than the nominal frequency which is usually 50 Hz or 60 Hz.

The power value of a picture is preferably the average power value of the picture to be displayed.

The invention concerns also an apparatus for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame. It comprises an average picture power circuit for determining a power value which is characteristic for the power level of the picture to be displayed, a frequency measurement circuit for measuring the frame frequency of the input picture, a power level control circuit for selecting a power level mode based on said power value and said frame frequency.

In a preferred embodiment, the power level control circuit comprises:

a first circuit for transforming the average picture power into a first number of sustain pulses, a second circuit for transforming the frame frequency of the input picture into a maximum allowed number of sustain pulses and a sustain gain, a third circuit for multiplying the first number of sustain pulses by said sustain gain and delivering a second number of sustain pulses, a fourth circuit for selecting the minimum number of sustain pulses between said second number of sustain pulses and said maximum allowed number of sustain pulses, a fifth circuit for transforming said minimum number of sustain pulses into a power level mode.

The first, second and fifth circuits are for example look-up tables.

The invention concerns also a plasma display device including this apparatus.

BRIEF DESCRIPTION OF THE DRAWINGS

Exemplary embodiments of the invention are illustrated in the drawings and are explained in more detail in the following description. In the drawings.

DESCRIPTION OF PREFERRED EMBODIMENTS

Figure 1:
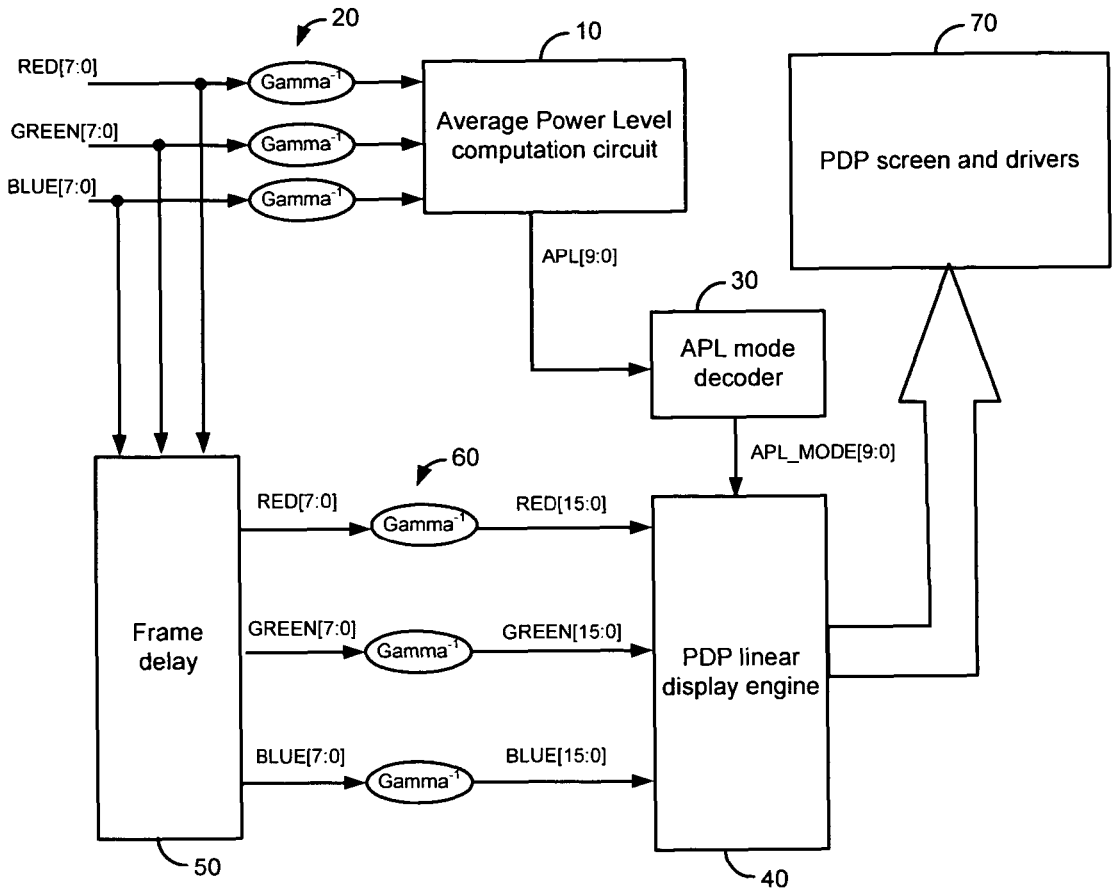
FIG.1 (PRIOR ART)
FIG. 1 shows a block diagram of a power level control device of a Plasma display Panel of the prior art.

FIG. 1 shows a block diagram of a power level control device of a Plasma display Panel of the prior art. As mentioned before, the principle implemented by this device is to compute the average power of a given picture and to select an appropriate power level mode (corresponding to a subfield organization) for sub-field coding.

In reference to FIG. 1, the input video signals RED[7:0], GREEN[7:0], BLUE[7:0] are provided to an Average Power Level computation circuit 10 after a de-gamma processing 20. The APL computation circuit 10 outputs a 10-bit APL signal, called APL[9:0], that is representative of the total luminance power required for displaying the input picture. The average power value APL[9:0] of a picture can be calculated by simply summing up the pixel values for all video input data and dividing the result through the number of pixel values multiplied by three. The signal APL[9:0] is then used by an APL mode decoder 30 for converting it into a power level mode, called APL_MODE[9:0], representing a subfield organization. In practice, the APL mode decoder 30 is a simple Look Up Table. Different examples of power level modes are given here:

Mode 204: 204 sustain pulses (full white)

Mode 205: 205 sustain pulses

. . .

Mode 700: 700 sustain pulses

Mode 1000: 1000 sustain pulses

For clarity reasons, the number of sustain pulses of a power level mode given in this example is identical to the mode number. The sustain pulses are distributed among the different subfields of the video frame. This distribution is not described because it does not have consequences on the power consumption.

The input video signals RED[7:0], GREEN[7:0], BLUE[7:0] are also provided to a PDP display engine 40 after being delayed by a frame delay circuit 50 and a de-gamma processing 60. Indeed input video signals have to be de-gammed by because the PDP display engine 40 has a linear gamma transfer function (the displayed brightness is proportional to number of generated sustain pulses). They also have to be delayed from a frame duration in order that the power level mode APL_MODE[9:0] determined by the decoder 30 corresponds to the video data supplied to the PDP display engine 40.

So the linear display engine 40 receives three 16-bit de-gammed input video signals RED[15:0], GREEN[15:0], BLUE[15:0] and the 10-bit APL mode value APL_MODE[9:0] that controls the number of sustain pulses to be generated. The subfield organization selected by the signal APL_MODE[9:0] is used by the display engine 40 for coding the video signals RED[15:0], GREEN[15:0], BLUE[15:0] and the signals outputted by the display engine 40 are then provided to the PDP drivers 70 for displaying the corresponding images.

According to the invention, it is proposed to select the power level mode as a function of the input frame frequency in such a way as to have as little as possible deviations from nominal peak white and full white values, at the same time that an overloading of the panel power supply is prevented. More particularly, the number of sustain pulses within the video frame is modified as a function of the input frame frequency. The input frame frequency is measured. If the measured frame frequency is lower than a nominal frame frequency (50 or 60 Hz), a power level mode with a higher number of sustain pulses per frame will be selected. If the measured frame frequency is higher than the nominal frequency, a power level mode with a lower number of sustain pulses per frame is selected.

Figure 2:
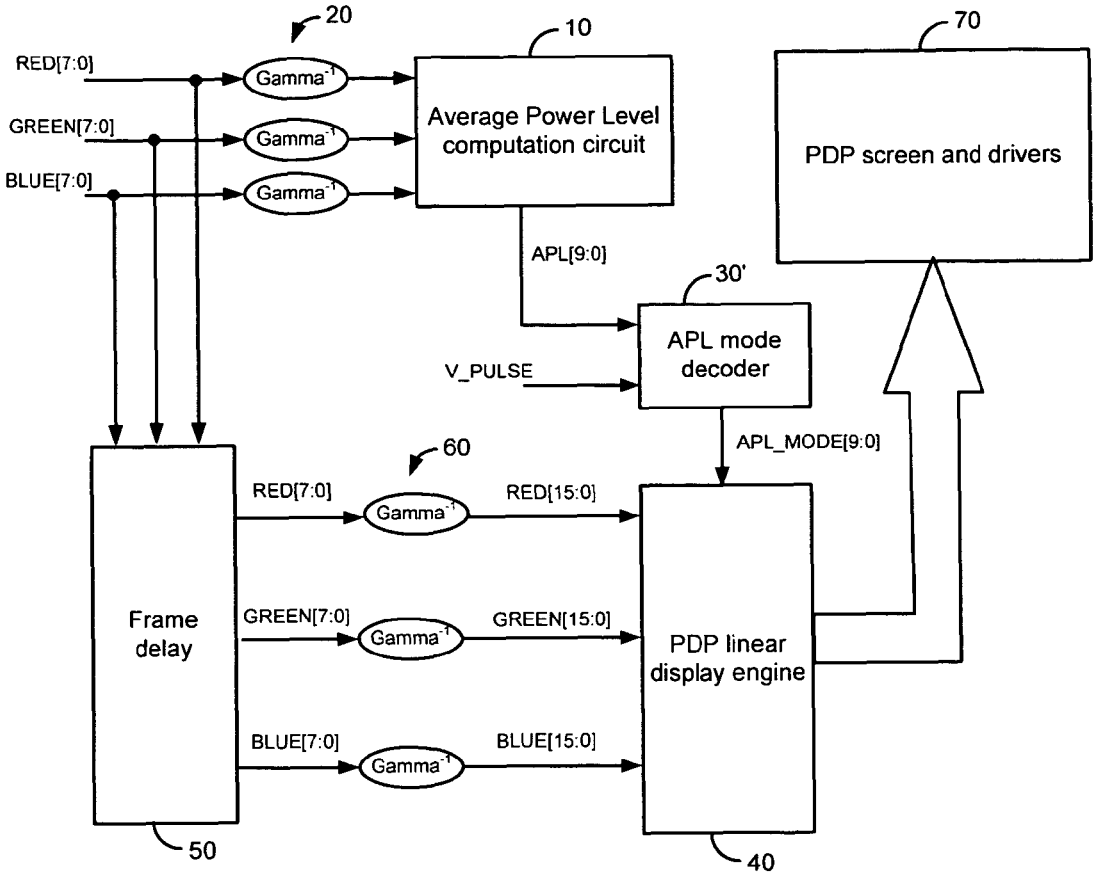
FIG. 2 shows a block diagram of a power level control device of a Plasma display Panel according to the invention.

FIG. 2 shows a block diagram of a power level control device of a Plasma display Panel according to the invention. The same reference signs are used in FIGS. 1 and 2 for the identical circuit blocks. In the FIG. 2, the APL mode decoder is modified and is now referenced 30'. It receives, in addition to the signal APL[9:0], a signal V_PULSE which is the vertical synchronization signal of the panel.

Figure 3:
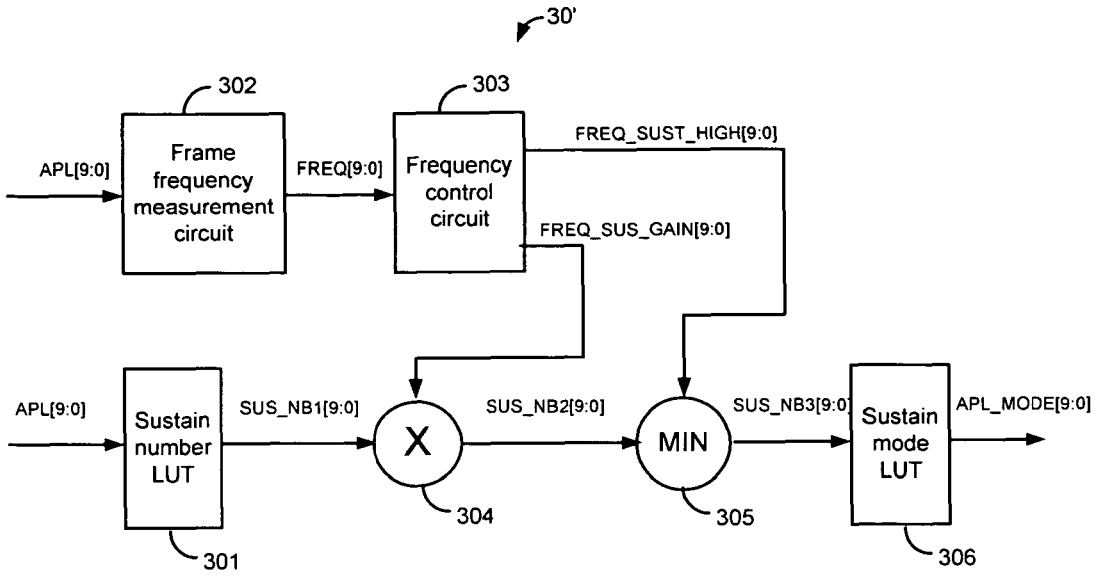
FIG. 3 shows a block diagram of an APL mode decoder of the device of FIG. 2.

FIG. 3 shows a block diagram of the APL mode decoder 30'. The proposed circuit 30' comprises a first look up table 301 for transforming the APL value APL[9:0] into a first number of sustain pulses SUS_NB1[9:0] corresponding to the number of sustain pulses of a power level mode adapted to the considered APL value. It comprises also a frame frequency measurement circuit 302 for measuring the frequency of the input frame from the signal V_PULSE. More particularly, it converts a series of V-pulses in an eight-bit coded digital signal FREQUENCY[7:0] that specifies the vertical frequency range of the input video signal. Such a measurement circuit is classical and usually involves resetting a counter at each vertical pulse V_PULSE and then comparing terminal count value (when counter is again reset by the following vertical pulse) with a set of reference values one for each possible frequency outcome. This frequency signal FREQUENCY[7:0] is then converted by a frequency control circuit 303, that can be a look-up table, into a set of two sustain number control signals:

- a signal FREQ_SUST_GAIN[9:0]: it is a sustain gain factor for decreasing or increasing the total number of sustain pulses within the video frame. This factor is greater than one when the input frame frequency is lower than the nominal frequency (50 or 60 Hz) and is smaller than one when the input frame frequency is higher than the nominal frequency.
- a signal FREQ_SUST_HIGH[9:0]: it represents the highest allowed number of sustain pulses for a given frame frequency. This is important because if the input frame frequency increases, there will be less time in the video frame and thus the maximum number of sustain pulses that can be generated within a video frame will be reduced.

The number of sustain pulses SUS_NB1[9:0] is then multiplied by the signal FREQ_SUST_GAIN[9:0] by means of a multiplier circuit 304. It delivers a second number of sustain pulses SUS_NB2[9:0]. In the example of FIG. 3, the gain factor FREQ_SUST_GAIN[9:0] is equal to the ratio $$\frac{\text{input frame frequency}}{\text{nominal frame frequency}} \times 512$$

in order that the gain factors have enough precision for different input frame frequencies. Consequently, the gain factor FREQ_SUST_GAIN[9:0] is divided by 512 in the multiplier circuit 304.

The second number of sustain pulses SUS_NB2[9:0] is then compared to the allowed number of sustain pulses FREQ_SUST_HIGH[9:0] by a circuit 305 that selects the minimal value between these two values. The number of sustain pulses, referenced SUS_NB3[9:0], outputted by this circuit is then converted by a sustain mode look up table 306 into a power level mode APL_MODE[9:0]. The content of the two look up tables 301 and 306 are such that that, if they were directly connected, their working were equivalent to the look up table used for the APL mode decoder 30 of the FIG. 1.

The principle of the functioning of the circuit 30' is to change as a function of the measured frame frequency FREQUENCY[7:0] the total number of sustain pulses SUS_NB1[9:0] outputted by the LUT 301 so as to select an appropriate power level mode APL_MODE[9:0].

Examples of the signals FREQUENCY[7:0], FREQ_SUST_GAIN[9:0] and FREQ_SUST_HIGH[9:0] are given below. In this table, it is supposed that the video frame comprises 200 sustain pulses for a full white picture and 1000 sustain pulses for a peak white picture. For the sake of simplicity, a reduced number of input frame frequencies around the nominal frequency of 60 Hz is shown.

| FREQUENCY[7:0] | FREQ_SUST_HIGH[9:0] | FREQ_SUST_GAIN[9:0] |
|---|---|---|
| 66 Hz | 900 | 465 (= 512/66 * 60) |
| 65 Hz | 800 | 472 |
| 64 Hz | 960 | 480 |
| 63 Hz | 970 | 487 |
| 62 Hz | 980 | 495 |
| 61 Hz | 990 | 503 |
| 60 Hz | 1000 | 512 (1/512) |
| 59 Hz | 1000 | 520 |
| 58 Hz | 1000 | 529 |

-continued

| FREQUENCY[7:0] | FREQ_SUST_HIGH[9:0] | FREQ_SUST_GAIN[9:0] |
|---|---|---|
| 57 Hz | 1000 | 538 |
| 56 Hz | 1000 | 548 |
| 55 Hz | 1000 | 558 |
| 54 Hz | 1000 | 568 (= 512/54 * 60) |

This table is shown as an example, and some other possibilities are allowed. If the input frame frequency is higher than the nominal frequency, the maximum allowed number of sustain pulses FREQ_SUST_HIGH[9:0] has to be reduced because the time for generating all the nominal sustain pulses is reduced (shorter frame period). If the input frame frequency is lower than the nominal frequency, the maximum allowed number of sustain pulses FREQ_SUST_HIGH[9:0] can not be increased due to the fact no power level mode APL_MODE[9:0] has been defined that generates more than 1000 sustain pulses.

As also shown on the table, the gain FREQ_SUST_GAIN [9:0] applied to the number of sustain pulses SUS_NB1[9:0] is inversely proportional to the input frame frequency and is equal to the ratio $$\frac{\text{input frame frequency}}{\text{nominal frame frequency}} \times 512$$

as mentioned above. In this way, the picture brightness remains approximately constant for the whole considered input frame frequency range.

This table will be carefully generated by the PDP manufacturer taking into consideration the physical limitations of its PDP control circuit and drivers.

The invention presented here is an improvement of the classical power management circuit. It proposes a simple and easy way for improving the power management in the whole input frame frequency range. The benefit for the user is that there will always be a produced image, even when handling non-standard input video signals.

The blocks shown in all the figures can be implemented with appropriate computer programs rather than with hardware components. Furthermore, the invention is not restricted to the disclosed embodiments.

Various modifications are possible and are considered to fall within the scope of the claims. e. g. other values of maximum allowed number of sustain pulses FREQ_SUST_HIGH[9:0] or of gain FREQ_SUST_GAIN[9:0] can be used instead, other input frame frequency range can be used.

The invention can be used for all kinds of displays which are controlled by using a PWM like control of the light emission for grey-level variation.

The invention claimed is:

1. Method for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame, comprising a step for determining an average power value which is characteristic for the picture to be displayed, and transforming the average picture power value into a first number of sustain pulses a step for measuring the frame frequency of the input picture, transforming the frame frequency of the input picture into a maximum allowed number of sustain pulses and a sustain gain, and multiplying the first number of sustain pulses by said sustain gain for delivering a second number of sustain pulses and a step for selecting a minimum number of sustain pulses between said second number of sustain pulses and said maximum allowed number of sustain pulses for transforming minimum pulses into a power level mode.

2. Apparatus for power level control in a display device having a plurality of luminous elements corresponding to the pixels of an input picture, wherein the time duration of a video frame is divided into a plurality of subfields during which each luminous element can be activated for light emission in small pulses, called hereinafter sustain pulses, corresponding to a subfield code word representative of the video level of the corresponding pixel, wherein a set of power level modes is provided for subfield coding wherein to each power level mode a characteristic subfield organization belongs, the subfield organizations being variable in respect to the number of sustain pulses during a frame, said apparatus comprising an average picture power circuit for determining a power value which is characteristic for the power level of the picture to be displayed, a first circuit for transforming the average picture power value into a first number of sustain pulses a frequency measurement circuit for measuring the frame frequency of the input picture and for transforming the frame frequency of the input picture into a maximum allowed number of sustain pulses and a sustain gain, a second circuit for multiplying the first number of sustain pulses by said sustain gain for delivering a second number of sustain pulses and a third circuit for selecting the minimum number of sustain pulses between said second number of sustain pulses and said maximum allowed number of sustain pulses and a power level circuit for transforming said minimum number of sustain pulses into a power level mode.

3. Apparatus according to claim 2, wherein the power level control circuit comprises:

a first circuit for transforming the average picture power into a first number of sustain pulses, a second circuit for transforming the frame frequency of the input picture into a maximum allowed number of sustain pulses and a sustain gain, a third circuit for multiplying the first number of sustain pulses by said sustain gain and delivering a second number of sustain pulses, a fourth circuit for selecting the minimum number of sustain pulses between said second number of sustain pulses and said maximum allowed number of sustain pulses, and a fifth circuit for transforming said minimum number of sustain pulses into a power level mode.

4. Apparatus according to claim 3, wherein the first, second and fifth circuits are look-up tables.

5. Apparatus according to claim 2, wherein it is included in a display device, in particular a plasma display device.

* * * * *